US008830016B2

(12) United States Patent
Rofougaran

(10) Patent No.: US 8,830,016 B2
(45) Date of Patent: Sep. 9, 2014

(54) LIQUID MEMS MAGNETIC COMPONENT

(71) Applicant: Broadcom Corporation, Irvine, CA (US)

(72) Inventor: Ahmadreza Rofougaran, Newport Coast, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 13/665,666

(22) Filed: Oct. 31, 2012

(65) Prior Publication Data

US 2014/0070911 A1 Mar. 13, 2014

Related U.S. Application Data

(60) Provisional application No. 61/699,183, filed on Sep. 10, 2012.

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS 6,515,404 B1 * 2/2003 Wong ..... 310/328
6,633,213 B1 * 10/2003 Dove ..... 335/78
6,781,075 B2 * 8/2004 Dove et al. ..... 200/182
2004/0150939 A1 8/2004 Huff
2007/0042802 A1 2/2007 Park et al.
2012/0068801 A1 * 3/2012 Duwel et al. ..... 336/20

FOREIGN PATENT DOCUMENTS

EP 1214854 A1 6/2002

OTHER PUBLICATIONS

Simon et al., "A Liquid-Filled Microrelay with a Moving Mercury Microdrop," Journal of Microelectromechanical Systems, vol. 6, No. 3, Sep. 1997; 9 pgs.
Sen, P.; Chang-Jin Kim, "A Liquid-Metal RF MEMS Switch with DC-to-40 GHz Performance," Micro Electro Mechanical Systems, 2009. MEMS 2009. IEEE 22nd International Conference on, pp. 904-907, Jan. 25-29, 2009; 4 pgs.
Kondoh et al., "High-Reliability, High-Performance RF Micromachined Switch Using Liquid Metal," Journal of Microelectromechanical Systems, vol. 14, No. 2, Apr. 2005; 7 pgs.
Chung-Hao Chen; Peroulis, D., "Liquid RF MEMS Wideband Reflective and Absorptive Switches," Microwave Theory and Techniques, IEEE Transactions on, vol. 55, No. 12, pp. 2919-2929, Dec. 2007; 11 pgs.

(Continued)

*Primary Examiner* — Bernard Rojas
(74) *Attorney, Agent, or Firm* — Garlick & Markison; Randy W. Lacasse

(57) ABSTRACT

A liquid micro-electro-mechanical system (MEMS) magnetic component includes a board, a channel, one or more windings, a magnetizing-doped droplet, and a droplet activating module. The channel is implemented or embedding in one or more layers of the board and the one or more windings are proximally positioned to the channel. The magnetizing-doped droplet is contained in the channel and is modified by the droplet activating module based on the control signal. By modifying the magnetizing-doped droplet with respect to the one or more windings changes an electromagnetic property of the liquid MEMS magnetic component.

12 Claims, 11 Drawing Sheets

(56) References Cited

OTHER PUBLICATIONS

Varadan, V. K., Vinoy, K.J. and Jose, K.A., "Microelectromechanical Systems (MEMS) and Radio Frequency MEMS, in RF MEMS and Their Applications," John Wiley & Sons, Ltd, Chichester, UK; pp. 1-49, May 2003; 49 pgs.
European Patent Office; European Search Report; EP Application No. 13004226.0; Nov. 22, 2013; 4 pgs.
Traille et al.; A Wireless Passive RCS-Based Temperature Sensor Using Liquid Metal and Microfluidics Technologies; Oct. 10, 2011; pp. 45-48; 2011 41st European Microwave Conference.
Sen et al.; A Liquid-Solid Direct Contact Low-Loss RF Micro Switch; IEEE Journal of Microelectromechanical Systems; Oct. 1, 2009; pp. 990-997; vol. 18, No. 5.
Sen et al.; Electrostatic Fringe-Field Actuation for Liquid-Metal Droplets; Jun. 5, 2005; pp. 705-708; vol. 1, No. 5; 13th International Conference on Solid-State Sensors, Actuators and Microsystems.
Latorre et al.; Electrostatic Actuation of Microscale Liquid-Metal Droplets; Journal of Microelectromechanical Systems; Aug. 1, 2002; pp. 302-308; vol. 11, No. 4.
European Patent Office; European Search Report; EP Application No. 13004236.9; Nov. 22, 2013; 4 pgs.

* cited by examiner tunable inductor or transformer tunable inductor or transformer programmable magnetic component 50 switch 54 (first position)

switch 54 (second position)

LIQUID MEMS MAGNETIC COMPONENT

CROSS REFERENCE TO RELATED PATENTS

The present U.S. Utility Patent Application claims priority pursuant to 35 U.S.C. §119(e) to U.S. Provisional Application No. 61/699,183, entitled "Liquid Micro Electro Mechanical Systems (MEMS) Devices and Applications," filed Sep. 10, 2012, which is incorporated herein by reference in its entirety and made part of the present U.S. Utility Patent Application for all purposes.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Technical Field of the Invention

This invention relates generally to radio communications and more particularly to liquid MEMS magnetic components that may be used in wireless communication devices.

2. Description of Related Art

Radio frequency (RF) communication devices are known to facilitate wireless communications in one or more frequency bands in accordance with one or more wireless communication protocols or standards. To accommodate multiple communication protocols, or standards, an RF communication device includes multiple versions (one for each protocol) of each section of the RF communication device (e.g., baseband processing, RF receiver, RF transmitter, antenna interface) and/or includes programmable sections. For example, an RF communication device may include a programmable baseband section, multiple RF receiver sections, multiple RF transmitter sections, and a programmable antenna interface.

To provide at least some of the programmable capabilities of a programmable section of an RF communication device, the section includes one or more programmable circuits, wherein the programmability is achieved via a switch-based bank of circuit elements (e.g., capacitors, inductors, resistors). For instance, selecting various combinations of a switch-based bank of capacitors and switch-based bank of inductors yields various resonant tank circuits that can be used in filters, as loads in amplifiers, etc. A recent advance in RF technology is to use integrated circuit (IC) micro-electro-mechanical system (MEMS) switches to provide the switches of a switch-based bank of circuit elements.

Issues with IC MEMS switches include minimal contact areas (which creates heat spots), bouncing of electrical contact (which limits use to cold switching), and a limited life cycle. In response to these issues, more recent advances in RF technology employ IC implemented liquid RF MEMS switches (which may also be referred to as electro-chemical wetting switches). As IC fabrication technologies continue to evolve and reduce the size of IC dies and components fabricated thereon, IC implemented liquid RF MEMS switches may have limited applications.

BRIEF DESCRIPTION OF THE SEVERAL VIEWS OF THE DRAWING(S)

DETAILED DESCRIPTION OF THE INVENTION

Figure 1:
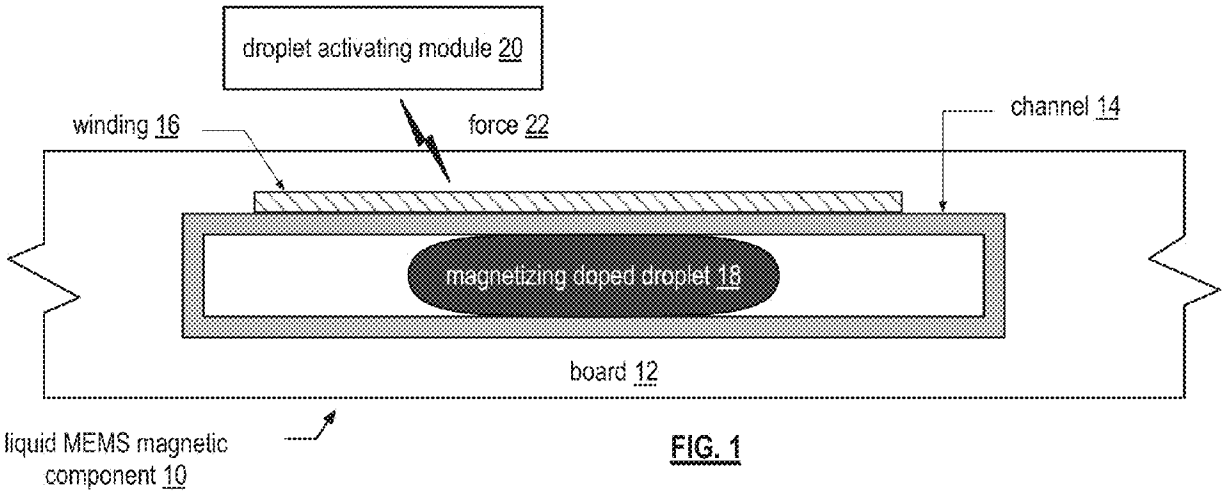
FIGS. 1 and 2 are schematic block diagrams of an embodiment of a liquid MEMS magnetic component in accordance with the present invention.
Figure 2:
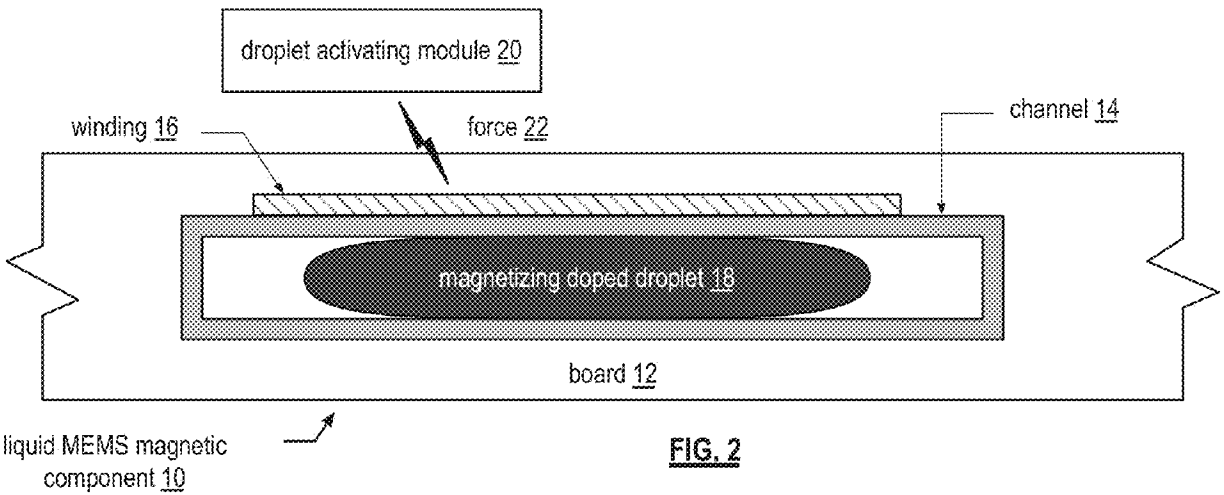

FIGS. 1 and 2 are schematic block diagrams of an embodiment of a liquid micro-electro-mechanical system (MEMS) magnetic component 10 that may be an inductor, a transformer, or a winding of a transformer and that may be used in a wireless communication device. A wireless communication device may be a portable computing communication device may be any device that can be carried by a person, can be at least partially powered by a battery, includes a radio transceiver (e.g., radio frequency (RF) and/or millimeter wave (MMW)) and performs one or more software applications. For example, the portable computing communication device may be a cellular telephone, a laptop computer, a personal digital assistant, a video game console, a video game player, a personal entertainment unit, a tablet computer, etc.

As shown, the liquid MEMS magnetic component 10 includes a board 12, a channel 14, one or more windings 16, a magnetizing doped droplet 18, and a droplet activating module 20. The board 12 may be a printed circuit board (PCB), an integrated circuit (IC) package substrate, or a redistribution layer (RDL) of a PCB or of an IC package substrate and it supports the channel 14 in one or more layers. For example, the channel 14 is fabricated in one or more layers of the board 12. As another example, the channel 14 is embedded into one or more layers of the board 12. Note that the channel 14 may have a variety of shapes. For example, the channel 14 may have a square-tubular shape, a cylinder shape, a non-linear square-tubular shape, or a non-linear cylinder shape, where non-linear refers to the axial shape of the channel being something other than a straight line (e.g., a meandering line, an arc, a circle, an ellipse, a polygon, or a portion thereof). In addition, the channel 14 may have its internal and/or external walls coated with an insulating layer, dielectric layer, a semiconductor layer, and/or a conductive layer.

The magnetizing-doped droplet 18 is contained in the channel 14 and the one or more windings 16 are proximally positioned to the channel 16 (e.g., on one or more surfaces of the channel). As shown in FIG. 1, the droplet activating module 20 applies a first level of force 22 upon the magnetizing-doped droplet 18 such that the droplet 18 has a first size and/or shape within the channel 14 and/or a first positioning with respect to the one or more windings 16. As shown in FIG. 2, the droplet activating module 20 applies a second level of force 22 upon the magnetizing-doped droplet 18 such that the droplet 18 has a second size and/or shape within the channel 14 and/or a second positioning with respect to the one or more windings 16. Modifying the magnetizing-doped droplet 18 with respect to the one or more windings 16 causes a change in an electromagnetic property (e.g., permeability, magnetic coupling, inductance, etc.) of the liquid MEMS magnetic component 10.

As an example, magnetizing-doped droplet 18 is a solution that includes suspending ferrite particles (or magnetic particles) and its shape, size, and/or position changes in the presence of a force 22 (e.g., electric field, magnetic field, compression, actuation, heat, etc.). For example, with a minimal (or inactive) force applied, the droplet 18 is in a contracted shape, which provides a first core property for a liquid MEMS inductor or transformer (i.e., the droplet 18 has the first shape, size, and/or positioning with respect to the winding(s) 16). When a sufficiently large (or active) force 22 is applied, the shape, size, and/or position of the droplet 18 change, which changes the core properties of the inductor or transformer (e.g., changes an electromagnetic property of the liquid MEMS magnetic component). Note that for a solenoid inductor, inductance is $L=\mu_0\mu_r N^2(A/l)$, where L is inductance, $\mu_0$ is the magnetic constant, $\mu_r$ is the relative permeability of the material within the solenoid, N is the number of turns, A is the cross-sectional area of the solenoid, and l is the length of the winding. As such, by changing the core properties of the magnetic component (e.g., changing the relative permeability within a range of an air core to an iron core by modifying the size, shape, and/or position of the droplet 18), its inductance is changed.

Figure 3:
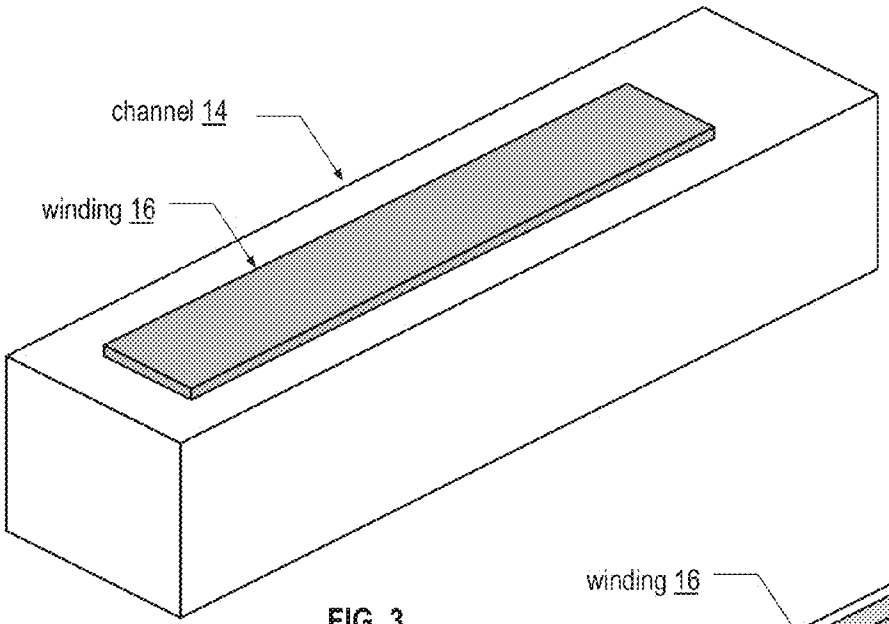
FIG. 3 is a schematic block diagram of an embodiment of a liquid MEMS inductor having one or more strip line windings in accordance with the present invention.

FIG. 3 is a schematic block diagram of an embodiment of a liquid MEMS tunable inductor having one or more strip line windings 16 proximally positioned to the channel 14. In this instance, the channel 14 has a square-tubular shape and may be of a size ranging from a few micrometers in height, width, and/or length to several centimeters in height, width, and/or length. The strip line winding 16 is of an electrically conductive material (e.g., copper, gold, aluminum, etc.) and may be deposited on the surface of the channel 14, may be embedded in a side of the channel 14, or may be on an inner surface of the channel 14 separated from the droplet 18 by an insulating layer. Note that the inductor may have two or more strip line windings 16 proximal to the channel 14 that are coupled in series and/or in parallel. For example, the inductor may include two strip line windings 16 with one winding on one surface of the channel 14 and the other strip line winding on another surface of the channel.

Figure 4:
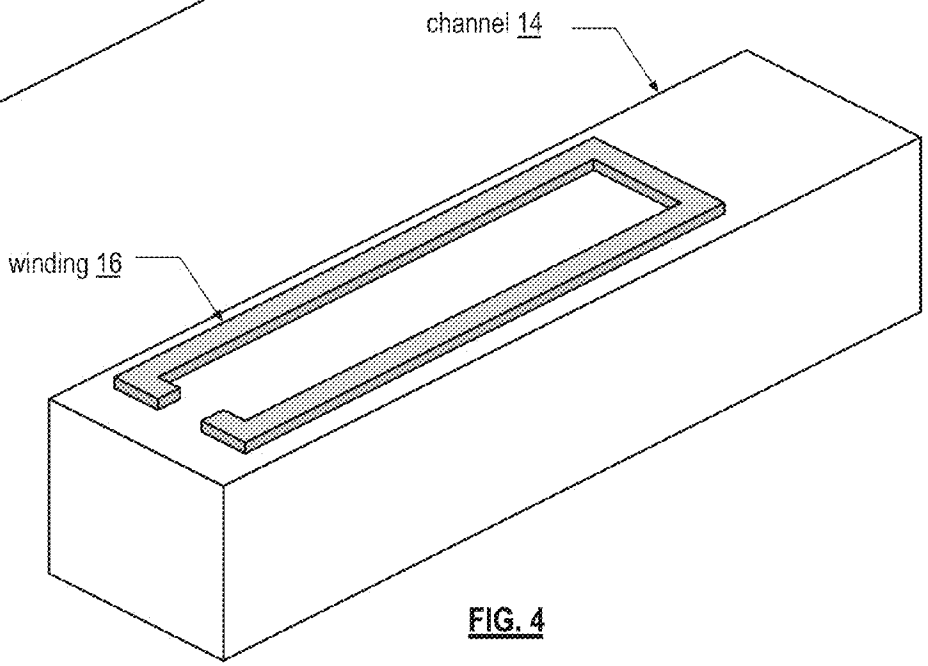
FIG. 4 is a schematic block diagram of an embodiment of a liquid MEMS inductor having one or more coil windings in accordance with the present invention.

FIG. 4 is a schematic block diagram of an embodiment of a liquid MEMS tunable inductor having one or more coil windings 16 proximally positioned to the channel 14. In this instance, the channel 14 has a square-tubular shape and may be of a size ranging from a few micrometers in height, width, and/or length to several centimeters in in height, width, and/or length. The coil winding 16 is of an electrically conductive material (e.g., copper, gold, aluminum, etc.), may include a partial turn, one turn, or many turns, may be deposited on the surface of the channel 14, may be embedded in a side of the channel 14, or may be on an inner surface of the channel 14 separated from the droplet 18 by an insulating layer. Note that the inductor may have two or more coil windings 16 proximal to the channel 14 that are coupled in series and/or in parallel. For example, the inductor may include two coil windings 16 with one winding on one surface of the channel 14 and the other winding on another surface of the channel.

Figure 5:
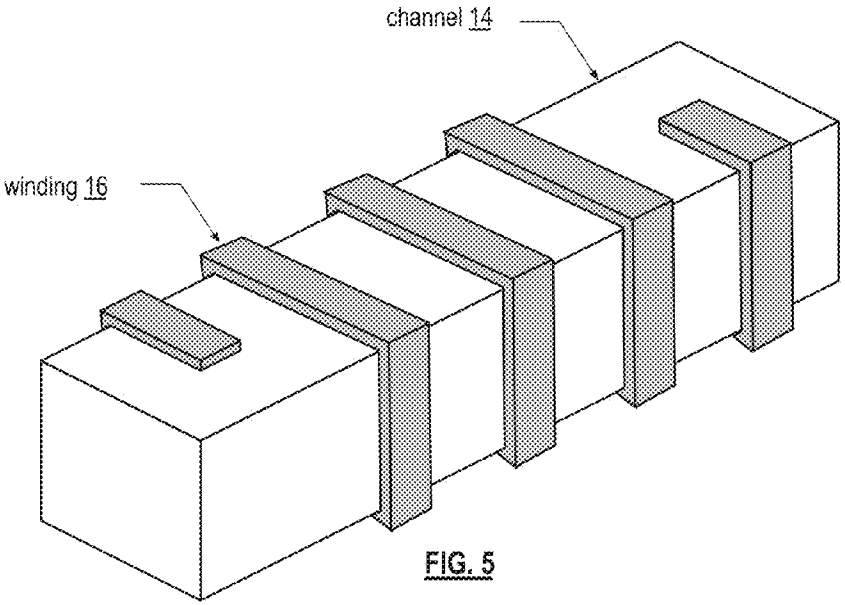
FIG. 5 is a schematic block diagram of an embodiment of a liquid MEMS inductor having a solenoid winding in accordance with the present invention.

FIG. 5 is a schematic block diagram of an embodiment of a liquid MEMS tunable inductor having a solenoid winding 16 proximally positioned to the channel 14. In this instance, the channel 14 has a square-tubular shape and may be of a size ranging from a few micrometers in height, width, and/or length to several centimeters in in height, width, and/or length. The solenoid winding 16 is of an electrically conductive material (e.g., copper, gold, aluminum, etc.), may include one turn or many turns, may be deposited on the surface of the channel 14, may be embedded in a side of the channel 14, or may be on an inner surface of the channel 14 separated from the droplet 18 by an insulating layer.

Figure 6:
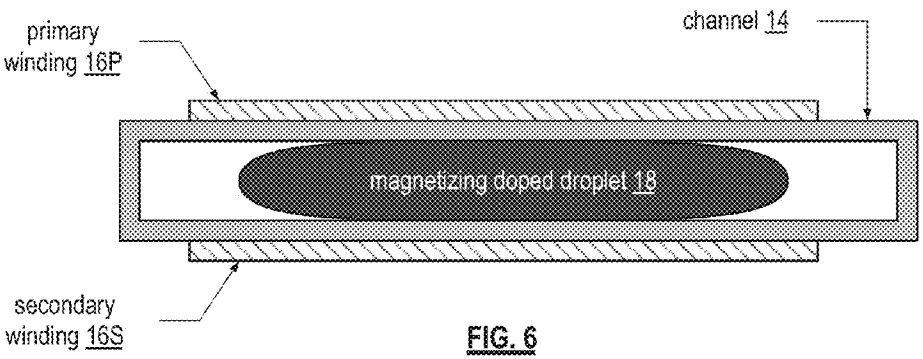
FIG. 6 is a schematic block diagram of an embodiment of a liquid MEMS transformer having a primary winding and a secondary winding in accordance with the present invention.

FIG. 6 is a schematic block diagram of an embodiment of a liquid MEMS tunable transformer that includes the channel 14, the magnetizing doped droplet 18, a primary winding 16P, and a secondary winding 16S. Each of the primary and secondary windings 16P and 16S may be a strip winding (as shown in FIG. 3), a coil winding (as shown in FIG. 4), or a solenoid winding as will be discussed with reference to FIGS. 7 and 8. In general, the magnetizing-doped droplet 18 is contained in the channel and is modified by the droplet activating module 20 based on the control signal. By modifying the magnetizing-doped droplet 18 with respect to the primary and secondary windings 16P and 16S changes an electromagnetic property of the liquid MEMS tunable transformer thereby facilitating tuning of the transformer.

Figure 7:
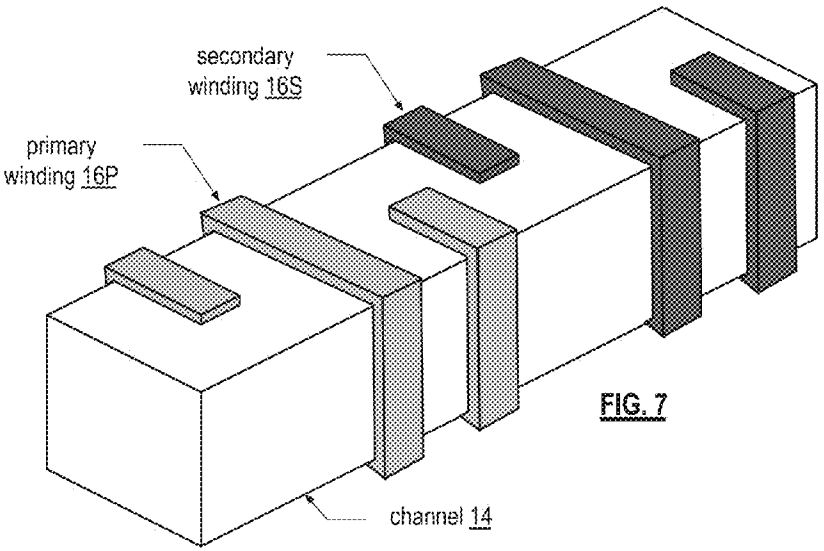
FIG. 7 is a schematic block diagram of an embodiment of a liquid MEMS transformer having a solenoid primary winding and a solenoid secondary winding in accordance with the present invention.

FIG. 7 is a schematic block diagram of an embodiment of a liquid MEMS transformer that includes the channel 14, the magnetizing doped droplet 18, a solenoid primary winding 16P, and a solenoid secondary winding 16S. In this embodiment, the primary and secondary windings 16P and 16S are aligned along the channel 14. While the channel 14 is shown to have a linear square tubular shape, it may, in the alternative, have a non-linear U-shaped square tubular (or cylinder) shape, a non-linear O-shaped, with an air gap, square tubular (or cylinder) shape, etc.

Figure 8:
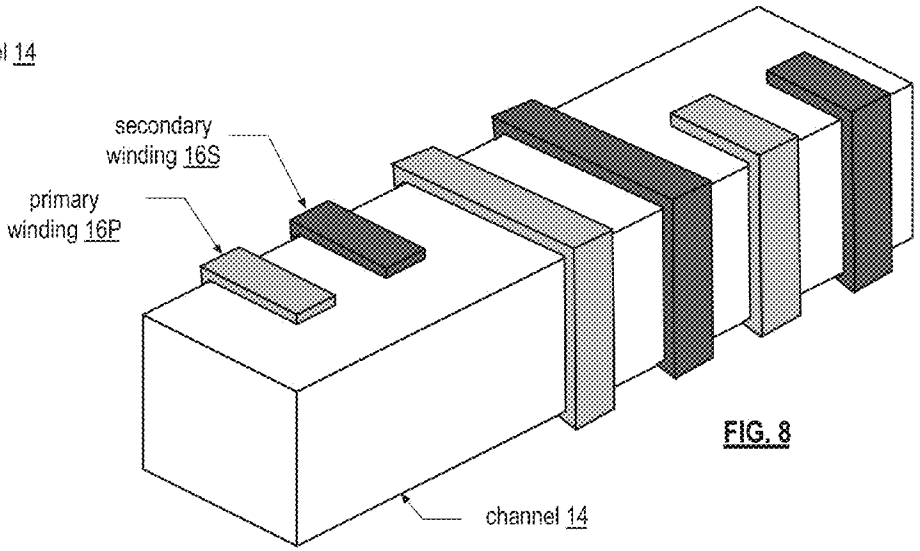
FIG. 8 is a schematic block diagram of another embodiment of a liquid MEMS transformer having a solenoid primary winding and a solenoid secondary winding in accordance with the present invention.

FIG. 8 is a schematic block diagram of another embodiment of a liquid MEMS transformer that includes the channel 14, the magnetizing doped droplet 18, a solenoid primary winding 16P, and a solenoid secondary winding 16S. In this embodiment, the primary and secondary windings 16P and 16S are interwoven along the channel 14. While the channel 14 is shown to have a linear square tubular shape, it may, in the alternative, have a non-linear U-shaped square tubular (or cylinder) shape, a non-linear O-shaped, with an air gap, square tubular (or cylinder) shape, etc.

Figure 9:
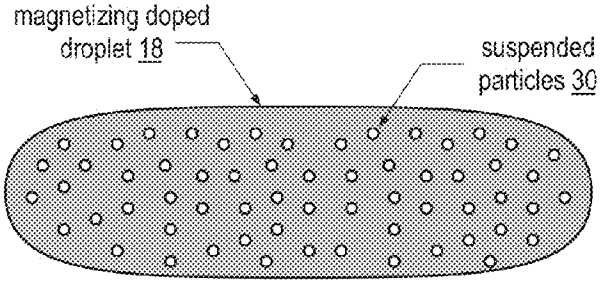
FIG. 9 is a schematic block diagram of an embodiment of a magnetized doped droplet of a liquid MEMS magnetic component in accordance with the present invention.

FIG. 9 is a schematic block diagram of an embodiment of a magnetized doped droplet 18 of a liquid MEMS magnetic component 10. The magnetized doped droplet 18 includes a non-magnetic liquid solution (e.g., magnetically and/or electrically inert liquid, gel, oil, etc.) and a plurality of particles 30 suspending in the liquid solution. The particles 30 may be ferrite particles and/or permanent magnetic particles. Magnetic particles may be used for a motor stator application and the ferrite particles may be used for inductors and/or transformers. Note that the non-magnetic liquid solution has a density that enables suspension of the particles. Further note that the particles may be coated with a material to reduce their individual densities. Alternatively, the magnetized doped droplet 18 may be a liquid colloid of the non-magnetic liquid solution and the particles 30 or a hydrocolloid that includes the particles 30 (e.g., ferrite or magnet).

Figure 10:
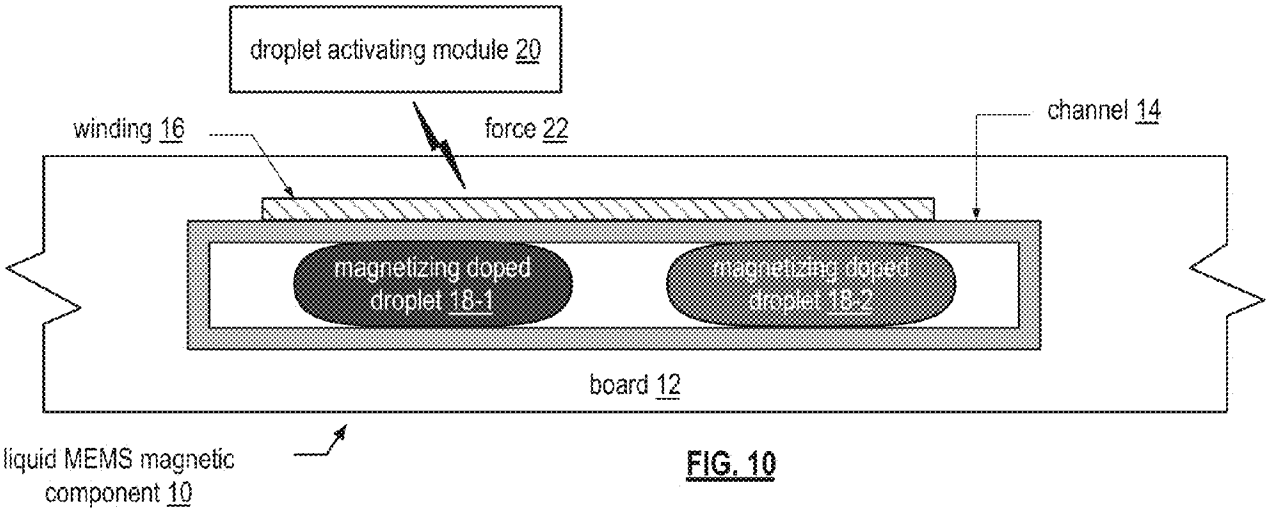
FIG. 10 is a schematic block diagram of an embodiment of a liquid MEMS magnetic component having multiple droplets in accordance with the present invention.

FIG. 10 is a schematic block diagram of an embodiment of a liquid MEMS magnetic component 10 that includes the board 12, the channel 14, one or more windings 16, a plurality of magnetized doped droplets 18-1 18-2, and the droplet activating module 20. In this embodiment, the magnetizing-doped droplet 18-1 has first magnetic properties (e.g., a first variable relative permeability based on a first concentration, size, material, etc. of the particles in the droplet 18-1) and the second magnetizing-doped droplet 18-2 has second magnetic properties (e.g., a second variable relative permeability based on a second concentration, size, material, etc. of the particles in the droplet 18-2). Since each droplet has a different permeability, they affect the core properties of the magnetic component differently as the force 22 is changed.

To further enhance the difference between the droplets, the liquid solution of each droplet may be different such that they react differently to the force. For example, the liquid solution of droplet 18-1 has a first density and the liquid solution of droplet 18-2 has a second density such that each reacts differently to an applied force (e.g., compression, heat, actuator, etc.).

While the droplets 18-1 and 18-2 are shown to be side-by-side in the channel, they may have a different orientation with respect to one another. For example, the droplets 18-1 and 18-2 may be stacked as opposed to side-by-side. As another example, a barrier physically separates the droplets 18-1 and 18-2 such that the droplets remain side-by-side or stacked. As yet another example, the densities of the droplets are different to maintain a physical separation.

Figure 11:
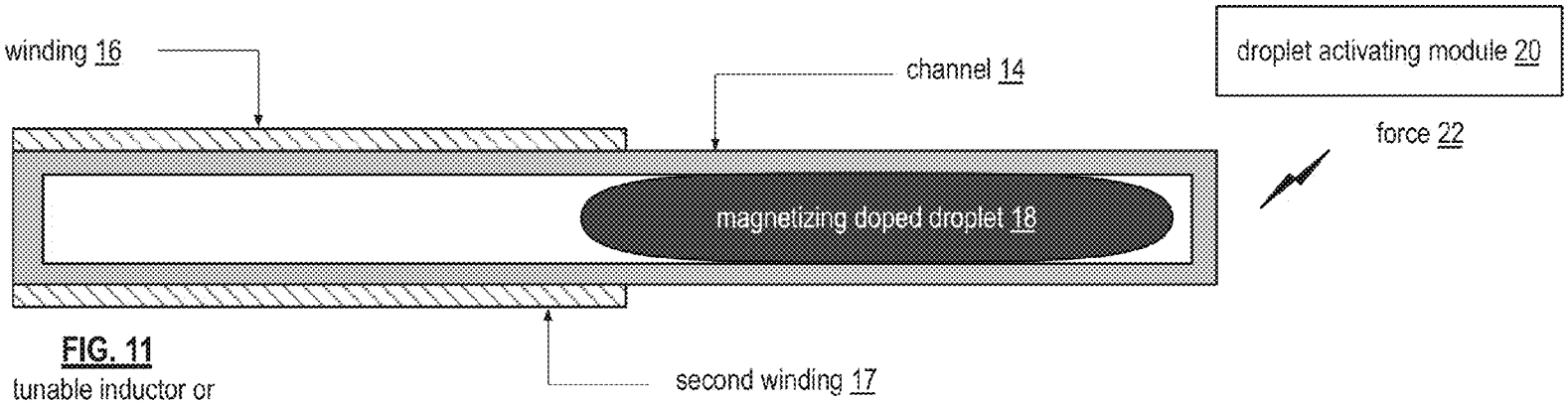
FIGS. 11 and 12 are schematic block diagrams of another embodiment of a liquid MEMS magnetic component in accordance with the present invention.
Figure 12:
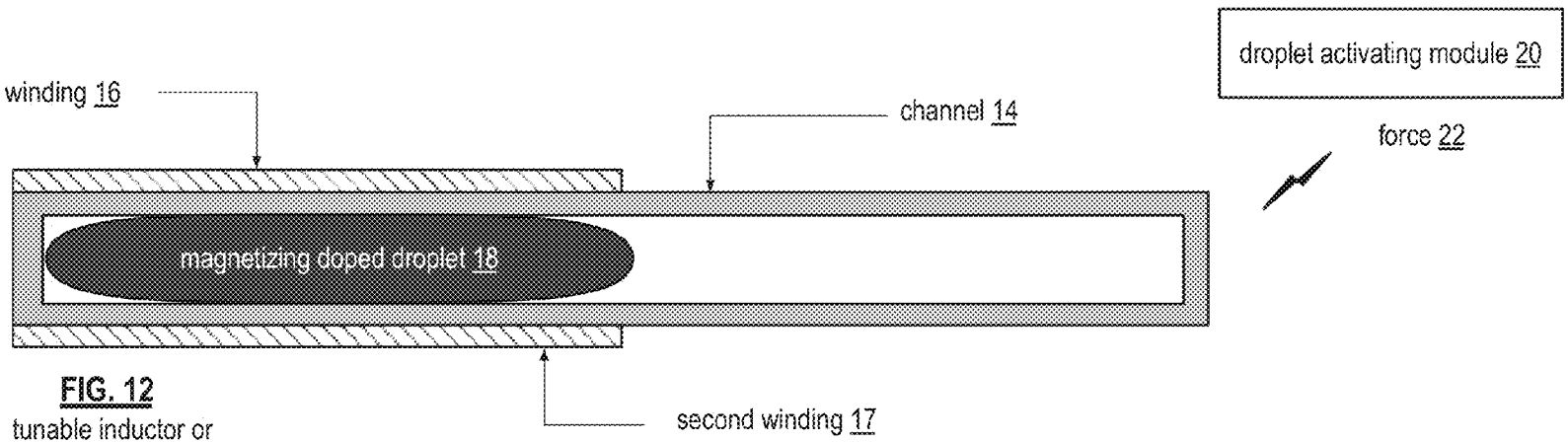

FIGS. 11 and 12 are schematic block diagrams of an embodiment of a tunable liquid MEMS magnetic component 10 (e.g., an inductor or a transformer) that includes a channel 14, a droplet 18, a first winding 16, a second winding 17, and a droplet activating module 20. The droplet activating module 20 may generate an electric field force, a magnetic field force, a pressure force, an actuator force, or a heat force 22 to move the position of the droplet 18 with respect to the windings 16 and 17. As the position of the droplet 18 changes with respect to the windings 16 and 17, the relative permeability of the inductor and/or transformer changes, which changes one or more properties of the inductor and/or transformer (e.g., changes inductance, magnetic coupling, saturation level, etc.). Note that, for a transformer, one of the windings 16 or 17 is the primary winding and the other is the secondary winding. Further note that, for an inductor, the windings 16 and 17 may be coupled in series or in parallel. As an alternative for an inductor, the second winding 17 may be omitted. Still further note that the windings 16 and 17 may be one or more of a strip line winding, a coil winding, or a solenoid winding.

As shown in FIG. 11, the position of the droplet 18 is substantially outside the area in the channel 14 between the winding 16 and 17. In this instance, the permeability of the magnetic component corresponds to the permeability of air or the permeability of a gas that is contained in the channel 14. As shown in the FIG. 12, the position of the droplet 18 is substantially within the area in the channel 14 between the windings 16 and 17. In this instance, the permeability of the magnetic component substantially corresponds to the permeability of the droplet 18. As the force 22 is varied, the position of the droplet 18 may range between its positions of FIGS. 11 and 12.

Figure 13:
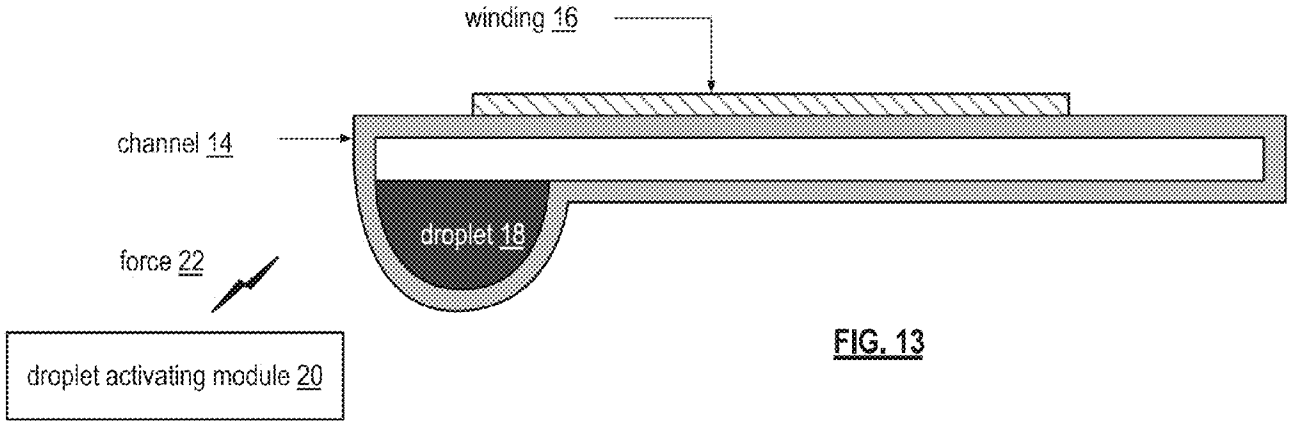
FIGS. 13 and 14 are schematic block diagrams of an embodiment of a droplet activating module of a liquid MEMS magnetic component in accordance with the present invention.
Figure 14:
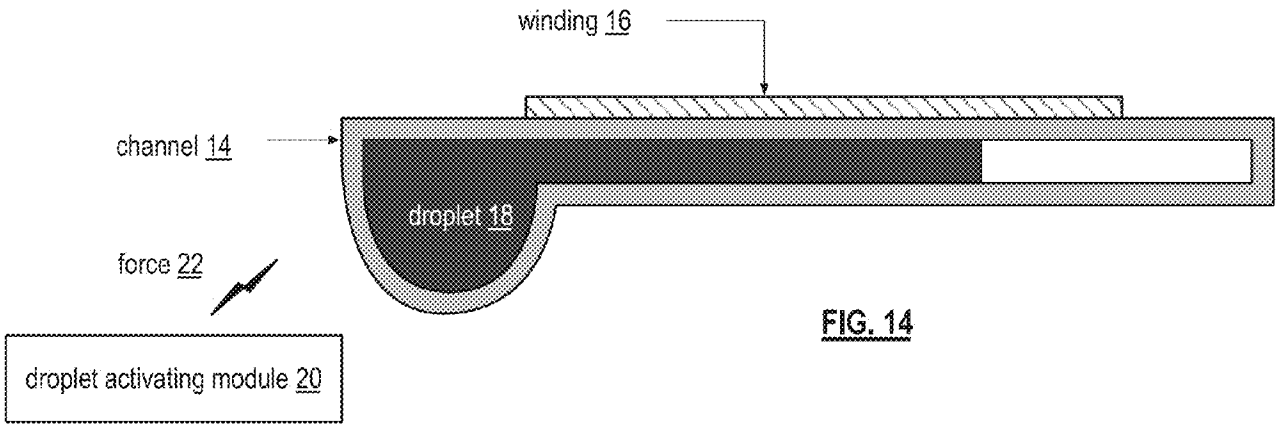

FIGS. 13 and 14 are schematic block diagrams of an embodiment of a tunable liquid MEMS magnetic component 10 (e.g., an inductor or a transformer) that includes a channel 14, a droplet 18, a winding 16, and a droplet activating module 20. The droplet activating module 20 generates an electric field force, a magnetic field force, a pressure force, an actuator force, or a heat force 22 that expands or pushes the droplet 18 into the channel 14, which includes a reservoir for holding the droplet 18. As the droplet 18 extends into the channel, it changes the relative permeability of the magnetic component, which changes one or more properties of the magnetic component (e.g., changes inductance, magnetic coupling, saturation level, etc.). Note that, for a transformer, another winding would be present. Further note the winding 16 may be one or more of a strip line winding, a coil winding, or a solenoid winding.

Figure 15:
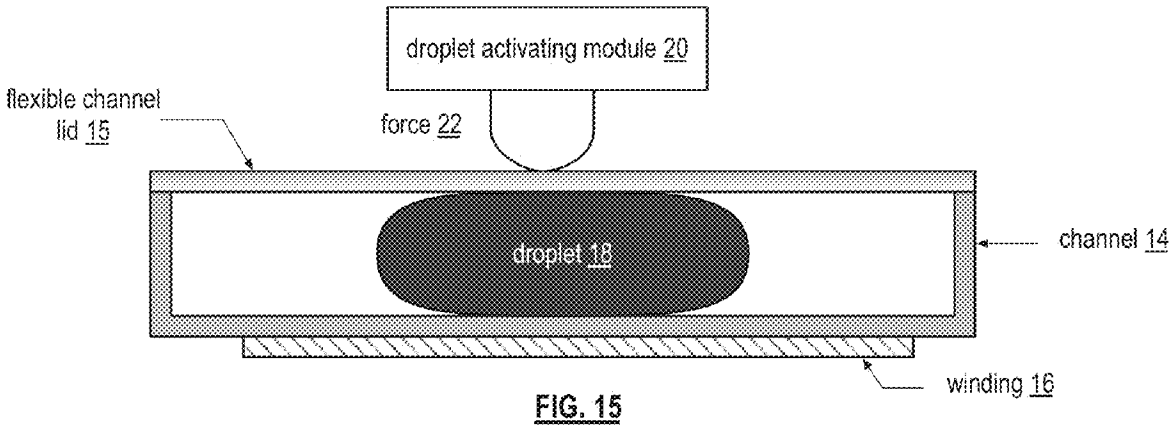
FIGS. 15 and 16 are schematic block diagrams of another embodiment of a droplet activating module of a liquid MEMS magnetic component in accordance with the present invention.
Figure 16:
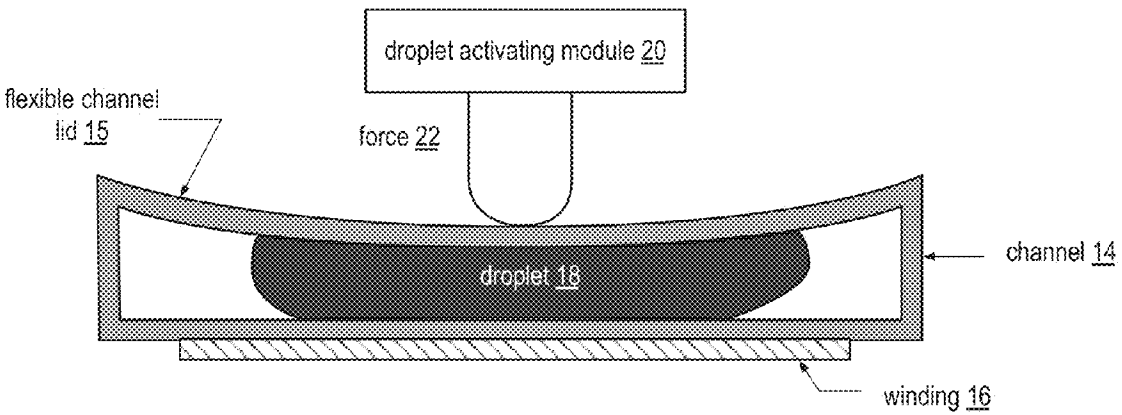

FIGS. 15 and 16 are schematic block diagrams of another embodiment of a tunable liquid MEMS magnetic component 10 (e.g., an inductor or a transformer) that includes a channel 14 (which includes a flexible lid 15), a droplet 18, a first winding 16, and a droplet activating module 20. The droplet activating module 20 generates a pressure force 22 or an actuator force 22 that presses on the flexible lid 15 of the channel 14, which changes the shape of the droplet 18. As the droplet 18 changes shape in response to the force, the relative permeability of the magnetic component, which changes one or more properties of the magnetic component (e.g., changes inductance, magnetic coupling, saturation level, etc.). Note that, for a transformer, another winding would be present. Further note the winding 16 may be one or more of a strip line winding, a coil winding, or a solenoid winding.

Figure 17:
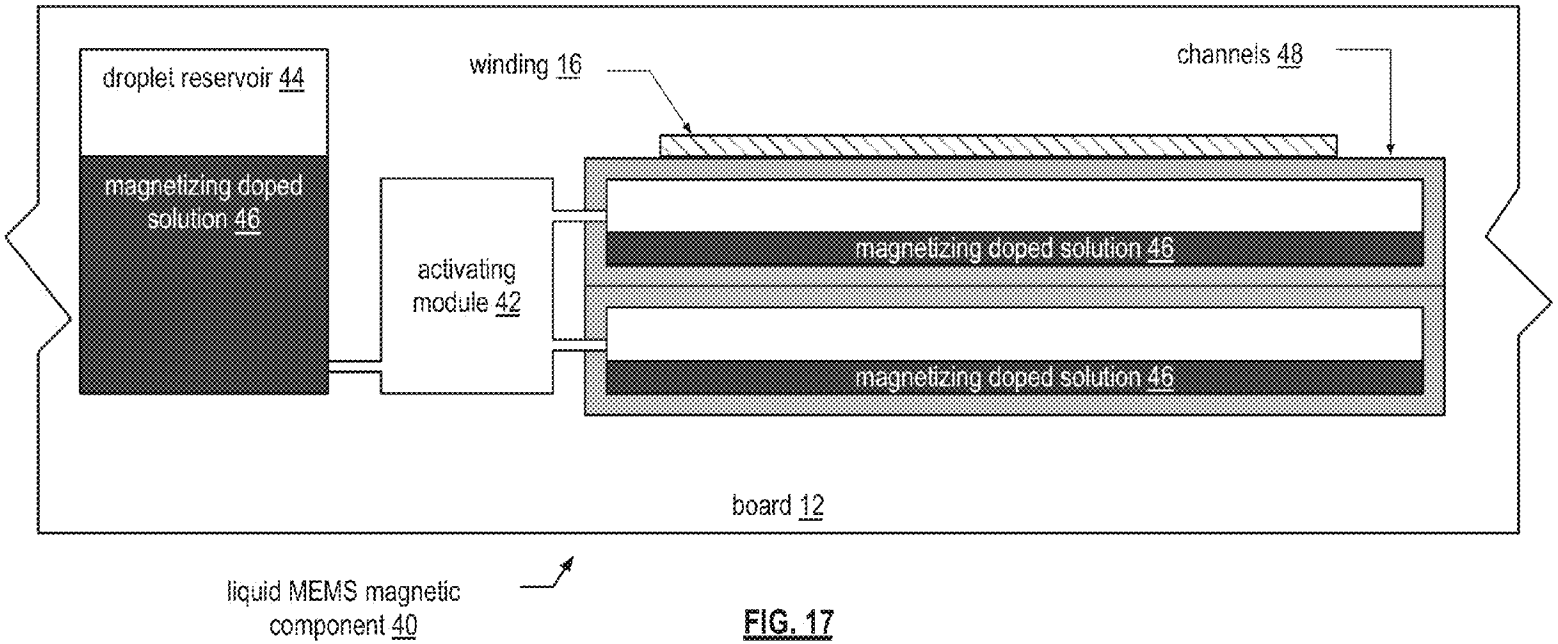
FIG. 17 is a schematic block diagram of another embodiment of a liquid MEMS magnetic component in accordance with the present invention.

FIG. 17 is a schematic block diagram of another embodiment of a liquid MEMS magnetic component 40 that includes a board 12, a winding 16, an activating module 42, a droplet reservoir 44, a magnetizing doped solution 46, and a plurality of channels 48. The magnetizing-doped solution 46, which is contained in the reservoir 44, includes a colloid of a plurality of ferrite particles and a non-magnetic liquid solution and/or a plurality of ferrite particles suspended in a non-magnetic liquid solution. Note that the magnetic component 40 may be a tunable inductor. Further note that the magnetic component 40 may include a secondary winding to function as a tunable transformer. Still further note that the winding 16 may be one or more of a strip line winding, a coil winding, or a solenoid winding.

In an example of operation, the activating module 42, which may be an actuator or pump, injects the magnetizing-doped solution 46 from the reservoir 44 into a least a portion of one or more channels 48. For example, the activating module 42 may inject, or pump, the magnetizing-doped solution 46 into one channel 48 to partially fill it or to fully fill it. As another example, the activating module 42 may inject, or pump, the magnetizing-doped solution 46 into two channels 48 to partially fill each, to fully fill each, or to partially fill one and fully fill the other. As the droplet 18 fills one or more channels, it changes the relative permeability of the magnetic component, which changes one or more properties of the magnetic component (e.g., changes inductance, magnetic coupling, saturation level, etc.).

Figure 18:
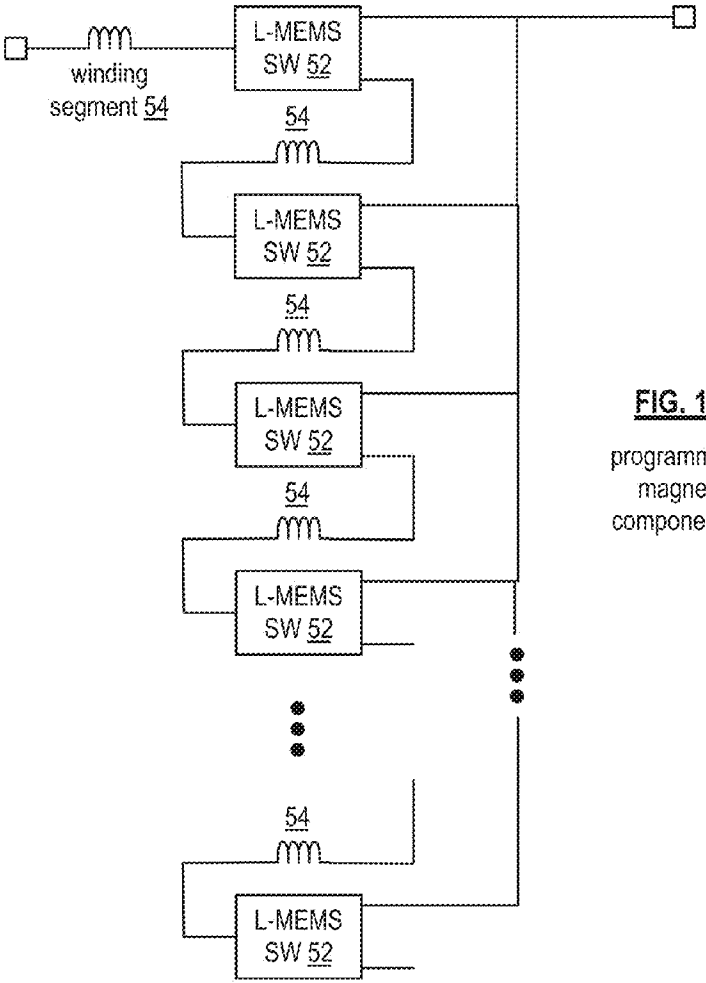
FIG. 18 is a schematic block diagram of an embodiment of a programmable magnetic component including liquid MEMS switches in accordance with the present invention.

FIG. 18 is a schematic block diagram of an embodiment of a programmable magnetic component 50 that includes a plurality of winding segments 54 and a plurality of liquid MEMS switches 52. In an implementation, one or more of the winding segments 54 may be implemented on the board 12 with the liquid MEMS switches 52 and remaining winding segments may be implemented on-chip. An example of the liquid MEMS switch 52 is further discussed with reference to FIGS. 20 and 21.

In an example of operation, one or more of the liquid MEMS switches 52 is activated to couple one or more of the winding segments 54 in series with one or more other winding segments 54 to produce a winding. The winding may be a winding of an inductor or a winding of a transformer. One or more of the winding segments 54 may be implemented as previously discussed to provide further programming capabilities or tuning of the magnetic component.

Figure 19:
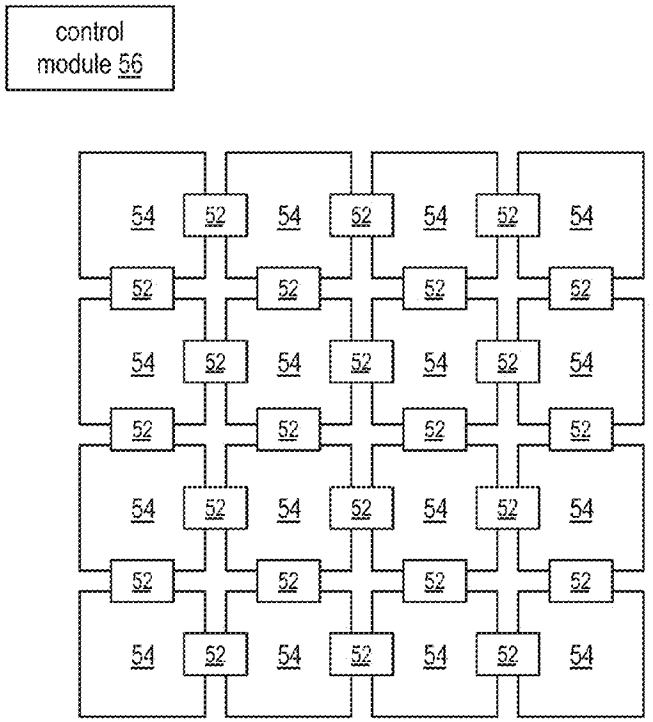
FIG. 19 is a schematic block diagram of another embodiment of a programmable magnetic component including liquid MEMS switches in accordance with the present invention.

FIG. 19 is a schematic block diagram of another embodiment of a programmable magnetic component 50 that includes a plurality of winding segments 54 and a plurality of liquid MEMS switches 52. In an implementation, one or more of the winding segments 54 may be implemented on the board 12 with the liquid MEMS switches 52 and remaining winding segments may be implemented on-chip.

In an example of operation, one or more of the liquid MEMS switches 52 is activated to couple one or more of the winding segments 54 in series and/or in parallel with one or more other winding segments 54 to produce a winding. In this manner, the winding elements 54 are coupled together to produce a desired shape, a desired thickness, a desired number of turns, and/or a desired length of a winding. The winding may be a winding of an inductor or a winding of a transformer. One or more of the winding segments 54 may be implemented as previously discussed to provide further programming capabilities or tuning of the magnetic component.

In another example of operation, the liquid MEMS switches 52 are activated to couple the winding segments 54 in series and/or in parallel to produce two windings. In this manner, the winding elements 54 are coupled together to produce a desired shape, a desired thickness, a desired number of turns, and/or a desired length for each of the windings.

Figure 20:
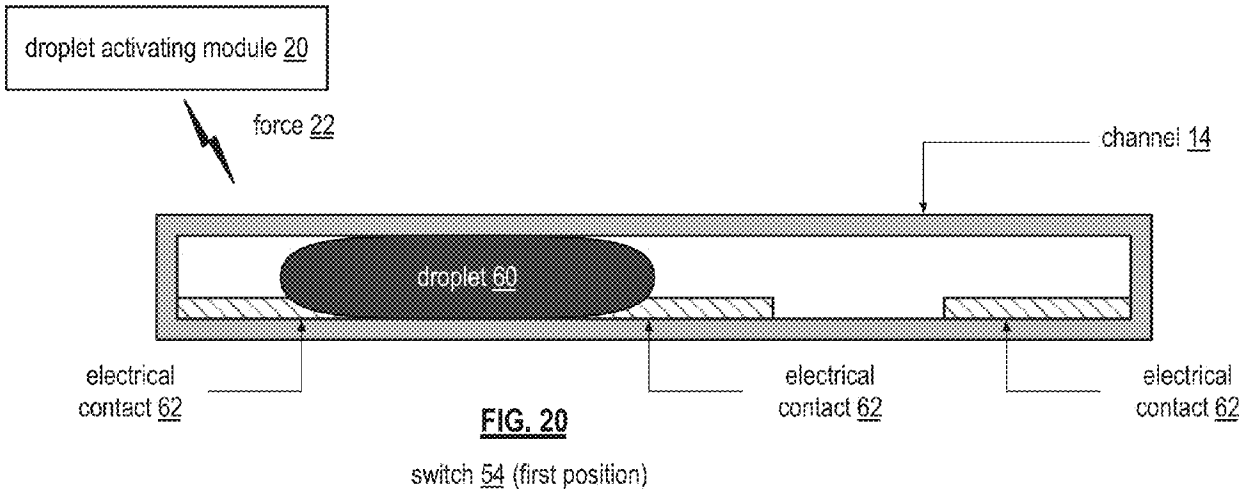
FIGS. 20 and 21 are schematic block diagrams of an embodiment of a liquid MEMS switch in accordance with the present invention.
Figure 21:
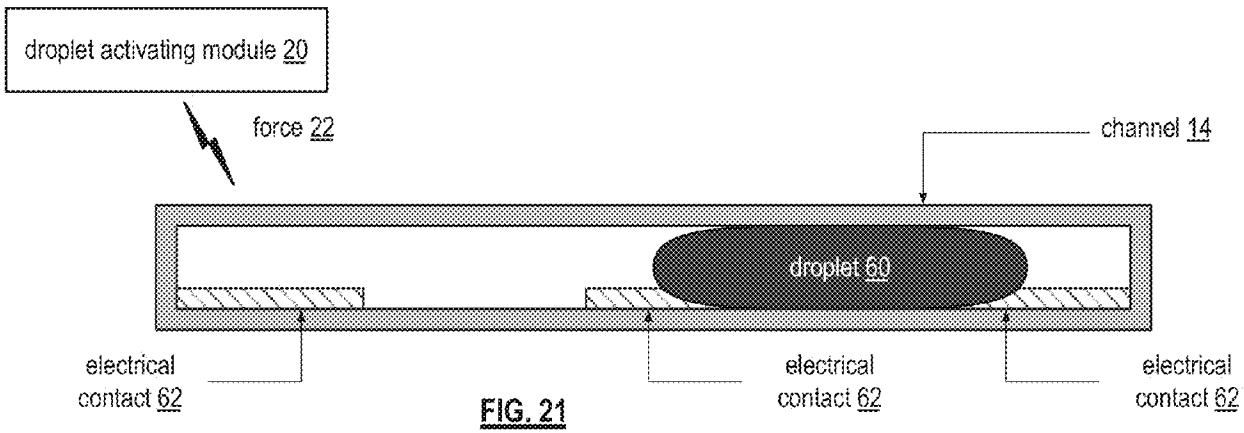

FIGS. 20 and 21 are schematic block diagrams of an embodiment of a liquid MEMS single pole double throw switch 52 for the switch of FIG. 18. The switch 52 includes a channel 14, a droplet 60, electrical contacts 62, and a droplet activating module 20. The droplet 60 is eclectically conductive (e.g., a liquid metal, a liquid with conductive particles, etc.) and its position changes in the presence of a force 22 (electric and/or magnetic field, pressure, actuator, etc.). With a minimal (or inactive) force 22 applied, the droplet 60 is in a first, which provides a first connection of the switch 52. When a sufficiently large (or active) force 22 is applied, the droplet 60 changes its position, which provides a second connection of the switch 52.

In an alternate embodiment, the switch 52 is a single pole single throw switch, which may be used for the switches of FIG. 19. In this embodiment, the switch includes two electrical contacts 62. With a minimal (or inactive) force 22 applied, the droplet 60 is not in contact with one of the electrical contacts, as such, the switch 52 is open. When a sufficiently large (or active) force 22 is applied, the droplet is in contact with the electrical contacts, as such, the switch 52 is closed.

While the liquid MEMS magnetic component 10 has been discussed as being implemented on a board 16, it could be implemented on an integrated circuit (IC) die. A liquid MEMS magnetic component 10 implemented on a board versus an IC die may be tens, hundreds, or thousands of times larger allowing for larger inductors and/or transformers to be implemented on a board versus the IC die. Nevertheless, there may certain applications where implementing the liquid MEMS magnetic component on one or more IC dies is more desirable than implementing the magnetic component on a board. In other applications, it may be desirable to implement a primary winding of transformer on a board and one or more secondary windings on one or more IC dies.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As may also be used herein, the terms "processing module", "processing circuit", and/or "processing unit" may be a single processing device or a plurality of processing devices. Such a processing device may be a microprocessor, microcontroller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

While the transistors in the above described figure(s) is/are shown as field effect transistors (FETs), as one of ordinary skill in the art will appreciate, the transistors may be implemented using any type of transistor structure including, but not limited to, bipolar, metal oxide semiconductor field effect transistors (MOSFET), N-well transistors, P-well transistors, enhancement mode, depletion mode, and zero voltage threshold (VT) transistors.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of the various embodiments of the present invention. A module includes a processing module, a functional block, hardware, and/or software stored on memory for performing one or more functions as may be described herein. Note that, if the module is implemented via hardware, the hardware may operate independently and/or in conjunction software and/or firmware. As used herein, a module may contain one or more sub-modules, each of which may be one or more modules.

While particular combinations of various functions and features of the present invention have been expressly described herein, other combinations of these features and functions are likewise possible. The present invention is not limited by the particular examples disclosed herein and expressly incorporates these other combinations.

What is claimed is:

1. A liquid micro-electro-mechanical system (MEMS) magnetic component comprises:

a board;

a channel in one or more layers of the board, the channel including at least one flexible section;

one or more windings proximally positioned to the channel;

a magnetizing-doped droplet contained in the channel; and a droplet activating module operable, based on a control signal, to modify the magnetizing-doped droplet with respect to the one or more windings by generating a force on the at least one flexible section, thereby changing an electromagnetic property of the liquid MEMS magnetic component.

2. The liquid MEMS magnetic component of claim 1 further comprises:

the one or more windings including a winding such that the liquid MEMS magnetic component is a tunable inductor.

3. The liquid MEMS magnetic component of claim 1 further comprises:

the one or more windings including a primary winding and a secondary winding such that the liquid MEMS magnetic component is a tunable transformer.

4. The liquid MEMS magnetic component of claim 1, wherein the magnetizing-doped droplet comprises:

a plurality of ferrite particles suspended in a non-magnetic liquid solution.

5. The liquid MEMS magnetic component of claim 1, wherein the magnetizing-doped droplet comprises:

a plurality of permanent magnetics particles suspended in a non-magnetic liquid solution.

6. The liquid MEMS magnetic component of claim 1 further comprises:

a second magnetizing-doped droplet, wherein the magnetizing-doped droplet has first magnetic properties and the second magnetizing-doped droplet has second magnetic properties.

7. The liquid MEMS magnetic component of claim 1, wherein the channel comprises one of:

a square-tubular shape;

a cylinder shape;

a non-linear square-tubular shape; and a non-linear cylinder shape.

8. The liquid MEMS magnetic component of claim 1, wherein the droplet activating module comprises at least one of:

an actuator;

a compression source; and an expansion source.

9. The liquid MEMS magnetic component of claim 8, wherein the droplet activating module provides a force on the magnetizing-doped droplet such that the magnetizing-doped droplet moves within the channel, wherein the magnetizing-doped droplet is responsive to at least one of:

compression from the compression source; and expansion from the expansion source.

10. The liquid MEMS magnetic component of claim 1, wherein the board comprises at least one of:

a printed circuit board (PCB);

an integrated circuit (IC) package substrate;

a redistribution layer (RDL) of a PCB or of an IC package substrate.

11. A liquid micro-electro-mechanical system (MEMS) magnetic component comprises:

a board;

a channel in one or more layers of the board, the channel including at least one flexible section;

one or more windings proximally positioned to the channel;

one or more magnetizing-doped droplets of varied magnetic properties contained in the channel; and a pressure force droplet activating module operable, based on a control signal, to modify at least one of the one or more magnetizing-doped droplets with respect to the one or more windings by generating a force on the at least one flexible section, thereby changing an electromagnetic property of the liquid MEMS magnetic component.

12. The liquid MEMS magnetic component of claim 11, wherein the droplet activating module provides a force on the one or more magnetizing-doped droplets such that the one or more magnetizing-doped droplets move within the channel, wherein the one or more magnetizing-doped droplets are responsive to at least one of or both of:

compression and expansion.

* * * * *